United States Patent [19]

Mehnert

[11] 4,066,019

[45] Jan. 3, 1978

[54] ELECTRONIC HAND GRENADE

[75] Inventor: Walter Mehnert, Ottobrunn, Germany

[73] Assignee: TECHNICO Development and Financing S.A., Fribourg, Switzerland

[21] Appl. No.: 710,678

[22] Filed: Aug. 2, 1976

[30] Foreign Application Priority Data

Aug. 13, 1975 Germany ..... 2536123

[51] Int. Cl.[2] ..... F42C 11/06; F42B 27/00

[52] U.S. Cl. ..... 102/70.2 R; 102/64; 102/69

[58] Field of Search ..... 102/70.2 R, 64, 65, 102/65.2, 65.4, 69

[56] References Cited

U.S. PATENT DOCUMENTS

| | | | |
|---|---|---|---|
| 3,596,078 | 7/1971 | Owens | 102/64 |
| 3,712,218 | 1/1973 | Fay | 102/70.2 R |
| 3,941,058 | 3/1976 | Gawlick et al. | 102/70.2 R |

*Primary Examiner*—Charles T. Jordan
*Attorney, Agent, or Firm*—Martin A. Farber

[57] ABSTRACT

A hand grenade comprising a plurality of explosive elements containing charges, the detonation of which timewise, is not ascertainable. The explosive elements are connected via a control-processing- and storage-electronics, in which from one or a plurality of signal transmitters, predetermined criterion such as definite amplitudes and/or frequencies and/or gradients which statistically occur, are led off and/or transformed and correspondingly processed for triggering or release of an ignition impulse for each individual explosive charge, respectively.

21 Claims, 6 Drawing Figures

ELECTRONIC HAND GRENADE

The present invention relates to an electronic hand grenade having a plurality of detonation elements connected with one another.

Hand grenades with a plurality of detonation elements connected with one another date already from the first World War as the state of the art. Since that time for the purpose of anti-tank combat, several stick hand grenades were connected to one another and detonated. Later, a ring with a plurality of explosive heads were arranged around a stick hand grenade, as this, for example, is disclosed in German Pat. No. 738,314. Aside from the fact that this type of hand grenade was very cumbersome and heavy and could be thrown only a relatively short distance, it was possible for the opposition to exactly estimate the detonation time and to take counter measures, whereby quite frequently the effect desired to be achieved led to no avail.

With explosive heads of bombs and grenades, designs are known with a number of detonation head elements which are connected with one another, or explosive heads equipped with a plurality of detonation devices (German Offenlegungsschrift No. 2,107,102). A special embodiment of these explosive heads were formed with a secondary explosive material logic and two detonation devices. Here in the explosive head there occur several successive detonations following one after another and a selection of the explosive direction. These prior solutions are suited for artillery grenades, etc., however not for hand grenades.

From German Auslegeschrift No. 1,134,315 a hand grenade has become known which is formed as a rotation body, whereby the explosive charge blasts out in the direction of the rotation axis and the hurling body is diverted from the original direction of flight. These measures are supposed to make it more difficult for the enemy to be able to predetermine the impact spot of the thrown grenade.

All embodiments of the prior art hand grenades have the disadvantage that their detonation times (as a rule namely three seconds from the moment of hurling) can be ascertained.

It is a task and object of the present invention to provide a hand grenade which possesses a plurality of explosive charges, the detonation of which timewise, however, is not ascertainable and cannot be comprended.

In accordance with another object of the present invention, the above mentioned task is solved by combining the explosive elements via a control-processing- and storage-electronics, in which from one or a plurality of signal transmitters 10, predetermined criterion such as definite amplitudes and/or frequencies and/or gradients which statistically occur, are led off (fed) and/or transformed and correspondingly processed for triggering or release of an ignition impulse for each individual explosive charge, respectively. Hereinafter the term "feeding and transforming, respectively," is defined as—feeding and/or transforming.

By these measures now a weapon is produced which (as soon as the adversary has recognized it, compels his remaining under cover until all complete detonations have occurred, the time intervals of which cannot be estimated by the adversary, as described hereinafter.

Moreover it is proposed in accordance with the present invention, for the signal transmitter to include a voltage source, to which signal transmitter there are coordinated one or several transformers corresponding thereto and one control-processing- and storage-electronics. In one embodiment, there is coordinated to the signal transmitter or transmitters one or several transformers (such as random number generators, digital counters) and one corresponding control-processing- and storage-electronics. By these measures in accordance with the present invention, the foundation is provided for holding the detonation time variable and unpredictable as well as to form the detonation triggering or release differently.

In a further embodiment in accordance with the present invention the control electronics is activated by means of a pull or rip device or the like and is associated with an acceleration transmitter, which upon the obtaining of a predetermined acceleration, for example impact acceleration (more descriptively deceleration), the ignition impulse is provided for the first stage and for the first explosive charge, respectively, while the further ignition impulses for the next explosive charges are provided by the electronics.

As an acceleration transmitter, here an impact detonator or percussion fuse can be used which triggers the first detonation and thereby sets the time expiration criterion in process or operation for the successive detonations.

For this purpose the present invention provides for the explosive charges to be located in concentrically arranged bodies, for example balls, or spherical shells whose inner explosive pressure or limit is smaller than the outer explosive pressure or limit. Also for every type of hand grenade the outermost body should be of equally large size, independent of the number of the remaining concentrically arranged bodies, and the explosive bodies which are united into one hand grenade constitute autonomous independent units, with their own voltage supply and electronics, or partially autonomous with central voltage supply and central electronics.

By these measures the enemy is held unaware over the number of the possible detonations. There can be, for example, three, four, or seven, yet also four, five or six charges. If for example the last, or the last two, contain only simply maneuver or blank charges and have no splinter or fragment action, thus the detonation and the corresponding ignition times thereof already can be used for attack, since the enemy still remains in complete cover in expectation of the coming detonation or detonations.

With the above and the other objects in view, the present invention will become more clearly understood, in connection with the following detailed description of preferred embodiments of the invention in connection with the accompanying drawings, of which:

Figure 1:
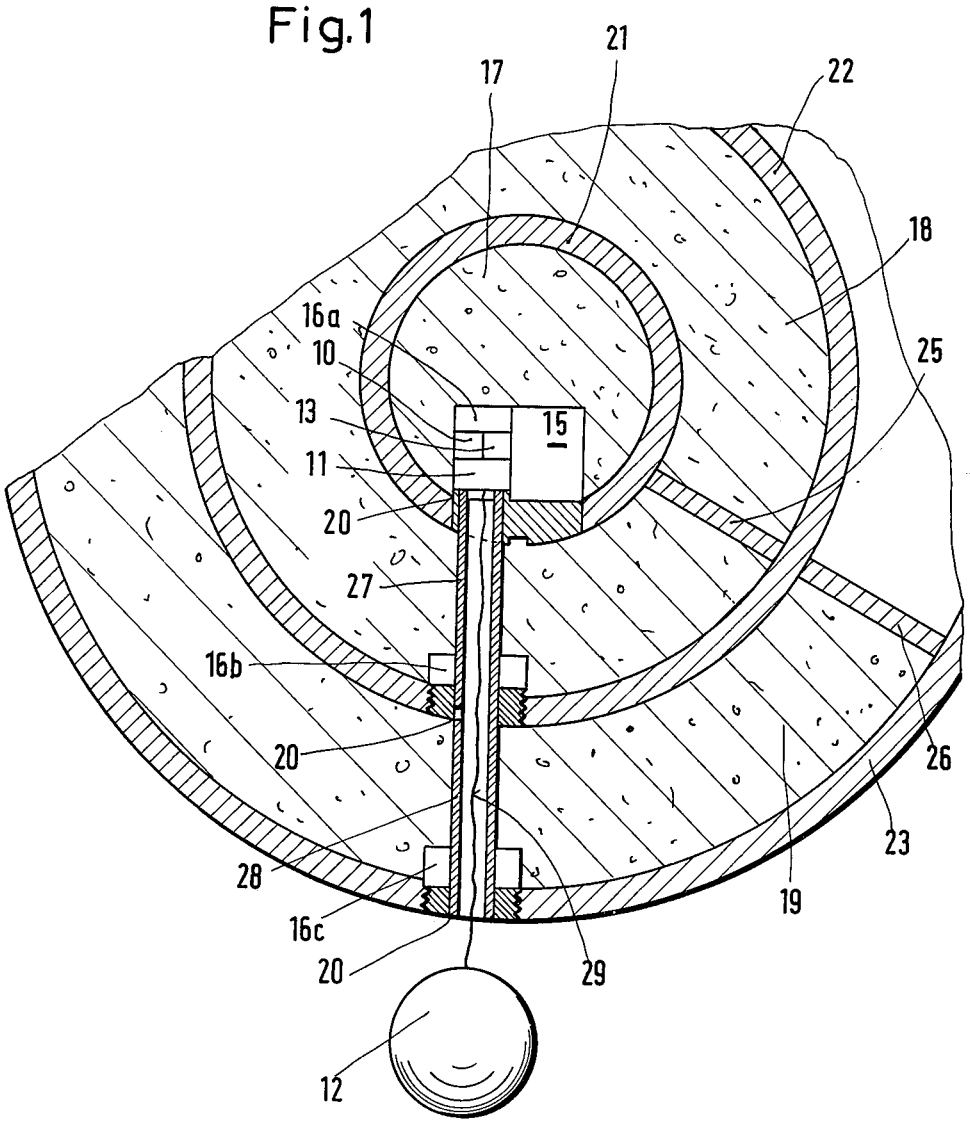
FIG. 1 is a partial cross-sectional view of one embodiment of the electronic hand grenade of the present invention in schematic illustration.

Referring now to the drawings, and more particularly to FIG. 1, there is shown an electronic hand grenade in accordance with the present invention. The center or core detonation body 21 contains therein an explosive charge 17, which charge, as well as all the other charges 18 and 19 which are disposed thereabout, are provided with splinter or fragment material. In the core body 21 there is located a set in screwable housing which can be screwed therein. The housing contains a control- processing- and memory (or storage) electronic device 15, an ignition transmitter 16*a*, a power source 10, one or more transformers 13 and a so-called arming device 11 with a rip cord 12 operatively attached thereto, and a signal- or ignition- distributor 20. This distributor 20 is in connection with the distributor 20 of the explosive or detonation body 22 via a so-called contact tubelet or tubule 27, and this again is in connection with the distributor 20 of the detonation body 23 via a corresponding contact tubelet 28. Aligned or congruent bores are formed in the explosive bodies 21, 22, 23 through which the contact tubelets are positioned coaxially together, jointly, and form a lead channel or connection piece for the rip cord 12 or an equivalent element, which arms the hand grenade or makes it live by means of the arming device 11. Each of the detonation bodies 22, 23 (or further detonation bodies which may be provided additionally thereabout, but which are not shown in the drawing, yet are the same as illustrated), is provided with an ignition device 16*b*, 16*c* . . . 16*n* respectively, which receives its supply and ignition impulse by means of the voltage source 10 and the electronics 15. The detonation housings 21, 22, 23 . . . etc. are preferably manufactured of synthetic or plastic material and indeed most favorably are formed in two shell halves, which are provided with hinge- and clamping-devices for holding the halves together. Spacers and support elements 25, 26 . . . etc., are provided for the concentric arrangement of all shells 21, 22, 23 . . . etc. according to the assembly. The outermost detonation body (for example 23 illustrated herein) can be provided with an impact detonator or percussion fuse and a contact transmitter 14, respectively, which after its detonation sets the measure of time for the random number generators 13*a*, 13*b* . . . 13*n*, after which time measure or interval the further detonations take place. By the arming device 11 and the contact transmitter 14, the voltage source 10 is set in active operative connection with the random number generators 13*a* . . . 13*n* and the memory electronics 15. In the latter, now the so-called momement of the ignition trigger or release is ascertained and in prescribed manner is programmed or stored, or immediately, retransmitted (or triggered). Thus the trigger impulse, for example, is then retransmitted to the ignition transmitters 16*a*, 16*b* . . . 16*n*, respectively, when twice the same amplitude occurs from the random number generators 13*a* and 13*b*, respectively, in a predetermined time interval. The variaions here are almost unlimited; thus one can autocorrelate or cross-correlate by means of the amplitude, and/or frequency gradients. From this it is evident that it is even impossible to merely approximately guess the moment of time of these ignitions. The enemy thus is compelled to remain under cover until the explosive material is consumed.

The explosive charges 17, 18, 19 are disposed in shells or balls which are concentrically arranged with respect to each other, the inner burst or explosive pressure of the balls being smaller than the outer burst or explosive pressure, in order to achieve an explosion of the outermost ball in every case without also destroying the inner ones. Preferably for all kinds of such hand grenades (thus those with three, four, five, or more, explosive devices) the outermost shell body 23 is formed with the same size, so that the number of explosive charges cannot be determined or estimated by a difference in size.

Figure 6:
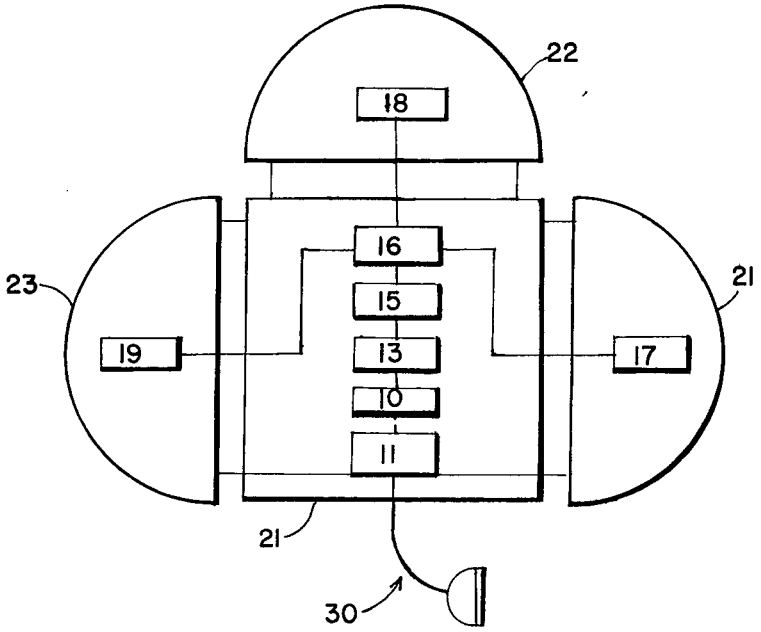
FIG. 6 is a block diagram showing a central circuitry for the hand grenade.
Figure 5:
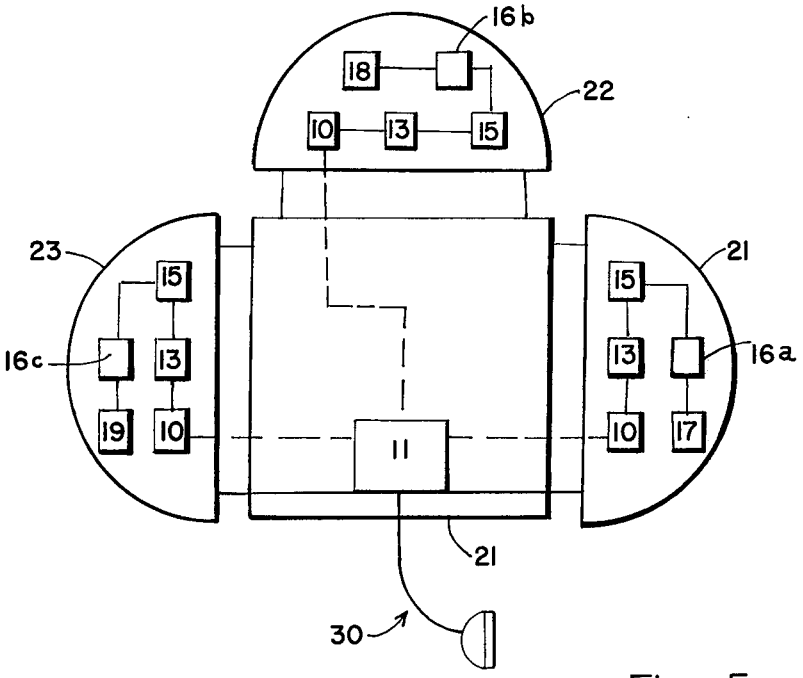
FIG. 5 is a block diagram showing autonomous separate circuitry for each explosive body.

The individual explosive bodies of the hand grenade, respectively, under circumstances, can be formed as independent units with a particular (i.e., its own) voltage supply (FIG. 5) particular transformers and particular electronics; however preferably it is equipped, partially independently, with one central voltage supply, central transformer and central electronics for all existing units. On the basis, of cost, weight and construction, the latter embodiment is recommended. Also the ignition transmitters 16*a*, 16*b*, can be centrally arranged in a single formation or design for all explosive charges, that is a single ignition transmitter 16 is located in the central explosive charge housing 21 (FIG. 6).

According to physical law, the destruction pressure of a shell or ball from an outward to an inward direction is substantially greater than from an inward to an outward direction. By this, the outermost balls explode in sequence without destroying the inner balls, until their turn arrive.

The at least one signal transmitter 10 can comprise the voltage source 10 alone if merely the magnitude or level of the voltage in given limits is required as the signal. The applied possibility is that the signals coming from the voltage source 10 are further processed over the transformer (or transmitter) 13 and the random number generators, whereby now, here, not only the amplitude, but also the speed of their changing come into play. As the voltage source 10 or signal transmitter 10, respectively, a thermal battery (for example made by Eagle-Picher Industries) can be used, which is activated shortly before arming or making the hand grenade live. This voltage source serves as the energy supply and can simultaneously be used as an information carrier (the signal transmitter), that is, the voltage level is a measure for the information content, for example, a dependency of the frequency of a multi-vibrator on the voltage level. The battery is activated with the help of the arming device via the rip cord 12. The arming device 11 itself comprises a pyroelectric charge which brings a salt to melting, which thus becomes the electrolyte. The charge is mechanically ignited.

Figure 2:
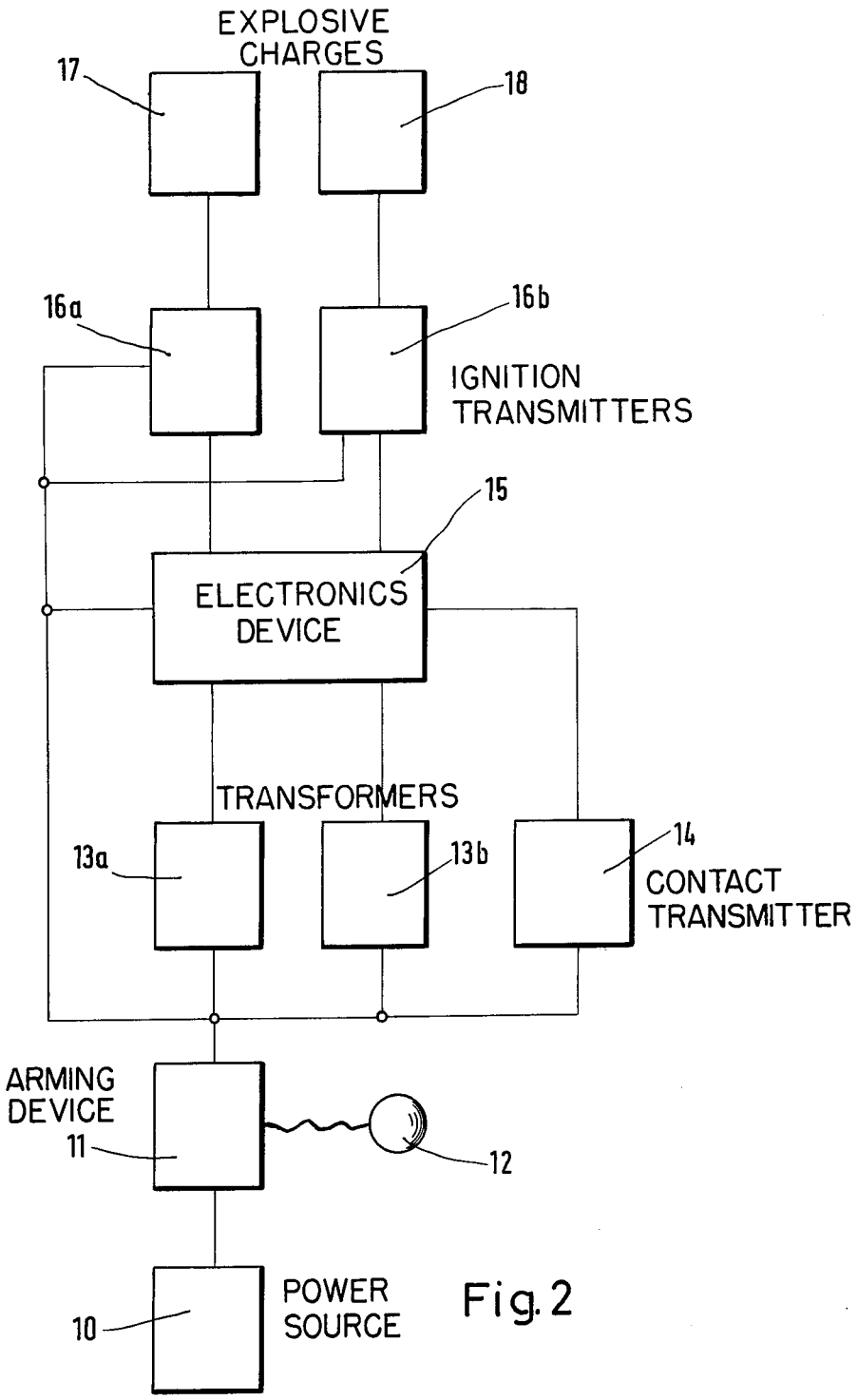
FIG. 2 is a circuit diagram of the hand grenade.
Figure 3:
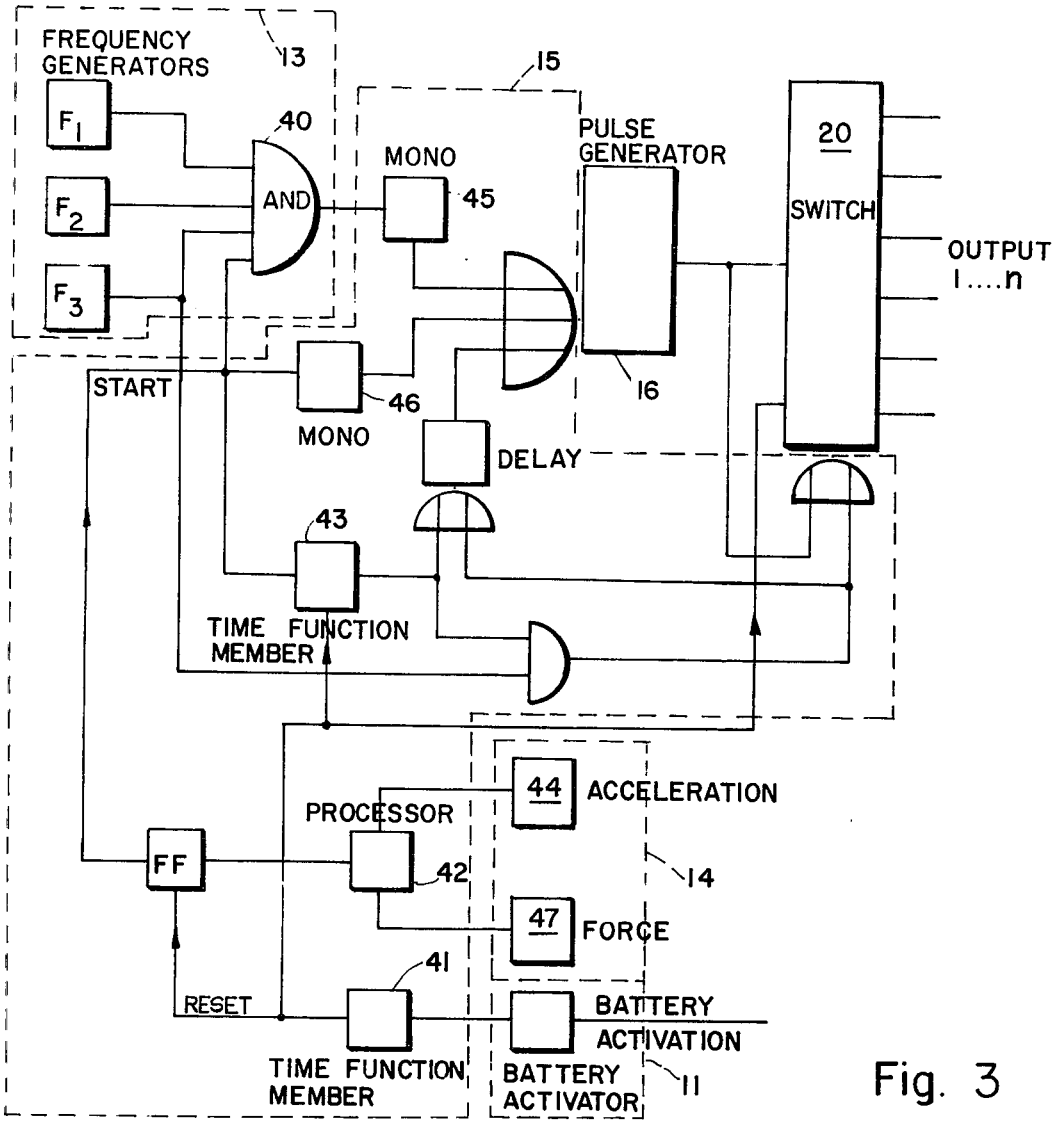
FIG. 3 is a more detailed circuit diagram.

Referring now again to the drawings and more particularly to FIG. 3, a more detailed electrical circuit diagram of FIG. 2 is illustrated. The random number generator 13 comprises, for example, three commercially standard simple frequency generators F1, F2, F3, which are connected by an AND switch 40. Upon coincidence of all output signals, the AND switch sends out an impulse. The control-, processing- and memory electronic device 15 also is illustrated in FIG. 3 connected to the output of the AND switch 40. After activating the battery, a time function member 41 insures that the electronics remains reset until the predetermined voltage is achieved. In the processor 42, which is connected to the contact transmitter 14, moreover, the criteria for the first ignition is formed from two limit values for force and acceleration, as well as one definite time value. The further ignition criteria are delivered from the random number generator 13. The time function member 43 which is connected to the output of the time function member 41 provides, that after a previously stored time (for example three minutes) all detonations take place. The two monos 45, 46 (e.g., monovibrators) serve for pulse shaping; the pulse generator or transmitter 16 produces the necessary electrical energy for the ignition of the electrical detonators.

The switch or distributor 20 is the distributor of the ignition impulses from the pulse transmitter 16 in the electronics device 15 to the individual ignition devices (the detonators) 17, 18, 19 provided in the explosive charges 17, 18, 19 via outputs 1 . . . *n*.

The contact transmitter 14 is an acceleration transmitter 44 in three axes and a force device or dynamometer 47 for the centripetal force (e.g. a foil or resistance strain guage) which emit a signal after attaining a limit value.

Figure 4:
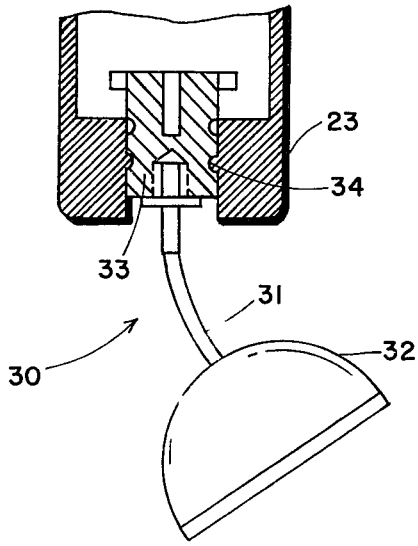
FIG. 4 is a cross-sectional view of a hurling- and catapult device for the hand grenade.

In order to obtain a greater range of throwing it can be advantageous to provide the assembled hand grenade with a hurling and catapult or sling device 30 (FIG. 4), similar to that formed with so-called hammer throw devices. The cord 31 with the handle 32 will be substantially shorter, so that the hand grenade does not brush in passing or touch the ground during the swinging drive motion and in this manner actuate the impact detonator. The cord 31 is attached to a force transmitting member 33, the latter being inserted in the outermost of the explosive bodies, e.g., in an inset portion explosive element 23 and held therein by an annular synthetic material bead 34. By all means this catapult device guarantees a substantially further throw than when the explosive ball charge is tossed or thrust.

For deception of the enemy and for sure and positive bringing up of the assault on the hostile position, it is proposed to provide the last or the two last explosive bodies, with a so-called blank charge which causes only a strong detonation bang or report, yet no longer provides a splinter action or actual detonation.

The explosive charge used herein is any conventional hand grenade charge, which is surrounded with a synthetic material shell in which steel balls are poured in.

While I have disclosed several embodiments of the invention, it is to be understood that these embodiments are given by example only and not in a limiting sense.

I claim:

1. An electronic hand grenade with a plurality of explosive elements connected with each other, comprising a plurality of explosive elements containing individual explosive charges, respectively, at least one signal transmitter means for providing signals of statistically occurring criteria, a control-processing- and storage-electronic means operatively connecting said explosive elements for feeding and transforming, respectively, and processing predetermined of said signals of statistically occurring criteria for triggering an ignition impulse for each of said individual explosive charges, respectively.

2. The electronic hand grenade as in claim 1, wherein said signal transmitter means includes a voltage source, said control-processing- and storage-electronic means is connected to said signal transmitter means.

3. The hand grenade as in claim 1, further comprising at least one transformer connected to said at least one signal transmitter means, said at least one transformer constitutes randon number generators, and said control-processing- and storage-electronic means is connected to said at least one signal transmitter means.

4. The electronic hand grenade as in claim 1, further comprising a rip means for operatively activating said electronic means, and acceleration transmitter means for initiating a first ignition impulse for one of said explosive charges upon reaching of a predetermined acceleration, said acceleration transmitter means is connected to said electronic means, and said electronic means further thereafter for releasing further ignition impulses for other of said explosive charges, respectively, in response to said signal transmitter means.

5. The electronic hand grenade as in claim 1, wherein said plurality of explosive elements include a plurality of bodies arranged concentrically relative to one another, said individual explosive charges, respectively, are disposed in said bodies, said bodies have an inner bursting pressure smaller than an outer bursting pressure.

6. The electronic hand grenade as in claim 5, wherein said bodies comprise balls.

7. The electronic hand grenade as in claim 5, wherein for each type of hand grenade an outermost of said bodies is uniformly of a same size independent of a total number of the other of said concentrically arranged bodies.

8. The electronic hand grenade as in claim 5, wherein said bodies are formed united into one hand grenade and constitute independent units, an individual voltage supply, an individual transformer constituting said at least one signal transmitter means connected to said individual voltage supply, and an individual of said electronic means, operatively connected to each of said units, respectively.

9. The electronic hand grenade as in claim 5, wherein said bodies are formed united into one hand grenade and comprise partly independent units, one central voltage supply, one central transformer constituting said signal transmitter means connected to said central voltage supply, and one central electronic means operatively, connected to all said partly independent units.

10. The electronic hand grenade according to claim 1, further comprising one central ignition transmitter means connected to said electronic means for providing ignition sparks to said individual explosive charges.

11. The electronic hand grenade as in claim 1, further comprising a separate ignition transmitter means connected to said electronic means and connected to each of said individual explosive charges for providing ignition sparks thereto, respectively.

12. The electronic hand grenade as in claim 5 wherein said bodies are formed with congruent aligned bores, respectively, a connection piece disposed in said bores in said bodies, rip cord means for operatively activating said electronic means and disposed in said connection piece.

13. The electronic hand grenade as in claim 1, further comprising a single pull cord means for operatively activating all of said explosive elements, the latter constituting independent or partially independent explosive elements.

14. The electronic hand grenade as in claim 1, further comprising a hurling- and catapult- means secured on the hand grenade on outermost of said explosive elements.

15. The electronic hand grenade as in claim 5, wherein said bodies are made of synthetic material.

16. The electronic hand grenade as in claim 5, wherein said explosive charges include a blank charge disposed in at least one of said bodies.

17. The electronic hand grenade as set forth in claim 1, wherein said signals of statistically occurring criteria are of defined amplitudes.

18. The electronic hand grenade as set forth in claim 1, wherein said signals of statistically occurring criteria are of frequencies.

19. The electronic hand grenade as set forth in claim 1, wherein said signals of statistically occurring criteria are of gradients.

20. The hand grenade as in claim 1, further comprising at least one transformer connected to said at least one signal transmitter means, said at least one transformer constitutes a digital counter, and said control-processing- and storage-electronic means is connected to said at least one signal transmitter means.

21. The electronic hand grenade as in claim 1, further comprising a rip means for operatively activating said electronic means, and acceleration transmitter means for initiating a first ignition impulse for one of said explosive charges upon impact, said acceleration transmitter means is connected to said electronic means, and said electronic means further thereafter for releasing further ignition impulses for other of said explosive charges, respectively, in response to said signal transmitter means.

* * * * *